United States Patent [19]

Birker

[11] Patent Number: 5,024,290

[45] Date of Patent: Jun. 18, 1991

[54] SOUND ABSORBING PANEL FOR INTERIOR WALLS

[75] Inventor: Otto Birker, K nacht, Switzerland

[73] Assignee: Lignoform Benken AG, Benken, Switzerland

[21] Appl. No.: 494,285

[22] Filed: Mar. 16, 1990

[30] Foreign Application Priority Data

Mar. 17, 1989 [CH] Switzerland ..... 993/89

[51] Int. Cl.[5] ..... E04B 1/82

[52] U.S. Cl. ..... 181/293

[58] Field of Search ..... 181/288, 289, 293; 52/144, 145

[56] References Cited

U.S. PATENT DOCUMENTS 2,954,838 10/1960 Nuorivaara ..... 52/145 X
4,261,433 4/1981 Propst ..... 181/288 X
4,555,433 11/1985 Jablonka et al. ..... 181/293 X
4,821,839 4/1989 D'Antonio et al. ..... 181/293 X
4,829,728 5/1989 Castelli ..... 52/145

FOREIGN PATENT DOCUMENTS 1057645 3/1954 France .
120577 1/1948 Sweden ..... 181/293
530029 12/1940 United Kingdom .

*Primary Examiner*—Brian W. Brown
*Attorney, Agent, or Firm*—Rothwell, Figg, Ernst & Kurz

[57] ABSTRACT

A sound absorbing panel (1) is disclosed having several grooves (3*a*,3*b*) opening in the shape of a funnel in parallel opposite surfaces. At their intersections the grooves (3*a*, 3*b*) form relatively small holes. The grooves (3*a*, 3*b*) exhibit a funnel-shaped cross-section, as a result of which sound emerging behind the panel (1) is dissipated and effectively absorbed in a backing layer consisting, for example, of fiber glass. The panel (1) is flexible and reflects incident light well.

12 Claims, 2 Drawing Sheets

SOUND ABSORBING PANEL FOR INTERIOR WALLS

BACKGROUND OF THE INVENTION

Field of the Invention

The invention relates to sound absorbing panels and, in particular, to perforated sound absorbing panels.

Description of the Prior Art

Perforated sound absorbing panels are well known in state of the art paneling. Such panels function on the basis of the Helmholtz resonator principle. The sound absorbing effect of the perforated panels is based on the circumstance that a significant portion of incident acoustic energy is absorbed but not reflected. The panels allow sound to pass through holes into the interior of the wall, but prevent a part of the sound that has penetrated from emerging again.

A perforated panel in the form of a veneered particle board is also known. The particle board has blind holes of relatively large radius, while the veneer has relatively small holes which direct the incident sound into the blind holes. This veneered particle board presents the difficulty first in that it is costly and labor-intensive, and secondly that the holes are easily fouled and for all practical purposes cannot be cleaned. The fact that the panel is almost inflexible limits its application.

SUMMARY OF THE INVENTION

An object of the invention is the creation of a sound absorbing panel that not only is characterized by excellent sound absorption properties but allows a large number of variations in architectural styling.

The panel also exhibits the Helmholtz effect, but avoids costly hole drilling. Measurements in a Kundt tube have yielded an average absorption factor $\alpha$ of 0.55. In the 500 to 2,000 Hz range the absorption rises from 0.6 to 0.9. Surprising is that micro fine holes, approximately 1.2 mm diameter, open surface approximately 1.5 percent, having considerably better absorbing capacity than drilled holes approximately 6.5 mm diameter, open surface about 20 percent. The panel as described and claimed in the present invention thus exhibits excellent acoustic properties at the high frequencies which for the most part are found to be especially disturbing. The milled faces allow shaping and bending of the panel without closing of the holes. Consequently, curved wall surfaces can also be faced with shaped or bent panels. The relatively small holes are barely visible, this being an effect often desired.

Different holes sizes can be obtained by simple means in a single panel by means of different groove depths. The open face amounts preferably to about 2 percent, while the diameter of the holes is, for example, approximately 1 mm. A panel such as this reflects incident light well and is also suitable as a light reflector, for example, above a workplace containing noise generating machines, such as a computer room.

In one embodiment of the invention, the grooves are funnel-shaped in cross-section. This panel is largely self-cleaning. Production of such holes is especially simple when the holes are V-shaped in cross-section.

In a preferred embodiment, the grooves are V-shaped in the bottom area of the groove, and the grooves have more or less parallel sides. The spacing between the grooves can be made smaller than in the case of V-shaped grooves, and accordingly, more holes can be produced per unit area.

Additional advantageous characteristics are illustrated by the following description and the drawings. Two examples of embodiments of the invention are explained as follows with reference to the drawings.

DESCRIPTION OF THE PREFERRED EMBODIMENTS

Figure 1A:
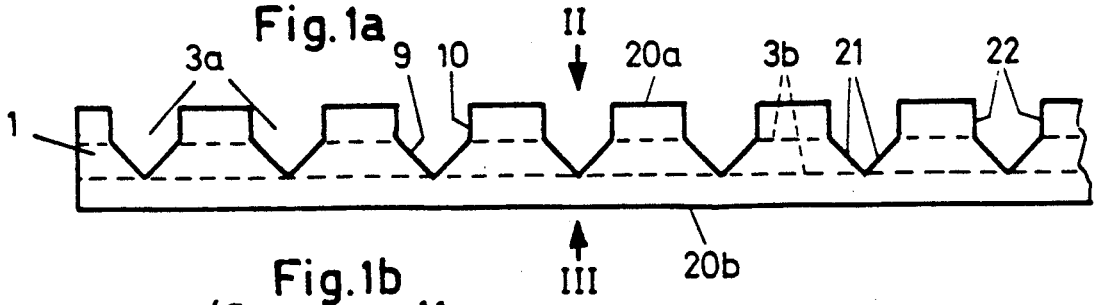
FIGS. 1*a* and 1*b* show partial views of the narrow side of a panel in first and second embodiments of the invention.
Figure 2:
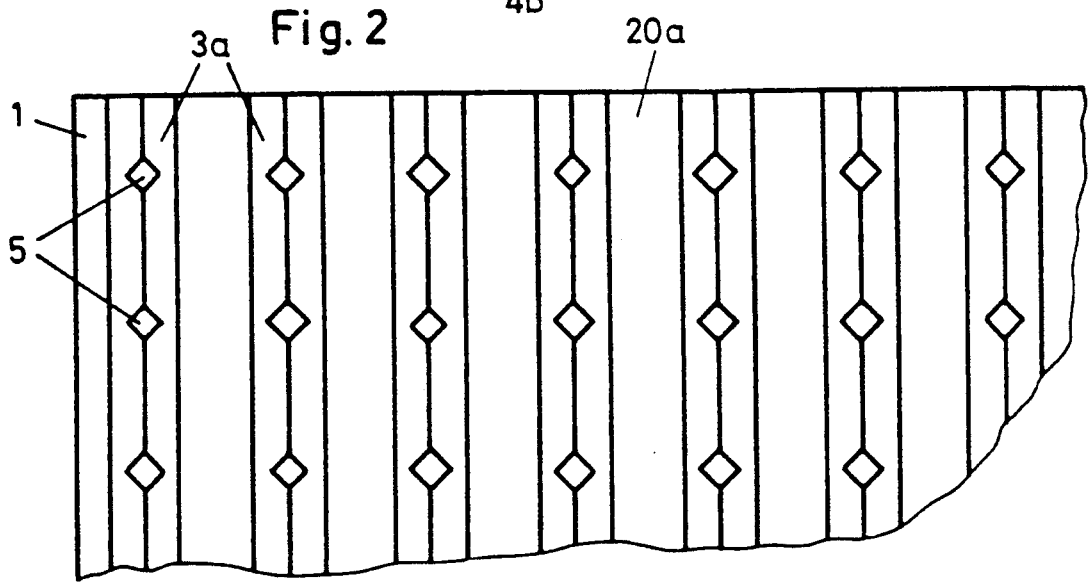
FIG. 2 shows a view of the panel in FIG. 1*a* as seen in the direction of arrow II.
Figure 3:
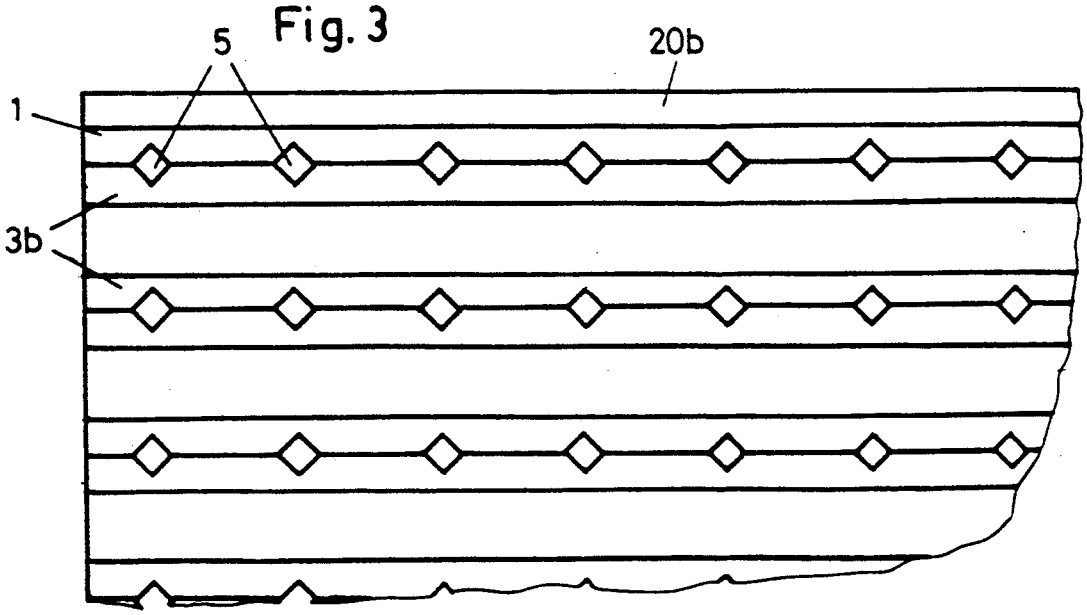
FIG. 3 shows a view of the panel in FIG. 1*a* as seen in the direction of arrow III.

The panel shown in FIG. 1*a* is a plywood panel approximately 7 mm thick. However, the panel may also consist of a suitable plastic. Greater or smaller thicknesses are, of course, also possible. As is shown by FIG. 1*a* in conjunction with FIGS. 2 and 3, several parallel and straight grooves 3*a* and 3*b* are incorporated in surfaces 20*a* and 20*b*. The groove depth is about 4 mm, so that square openings 5 are present at the intersections of grooves of different surfaces. As is seen from FIG. 1*a*, the grooves have parallel side surfaces 22 and intersecting surfaces 21. The surfaces 21 form the groove bottom and intersect at an angle of approximately 90°.

Figure 1B:
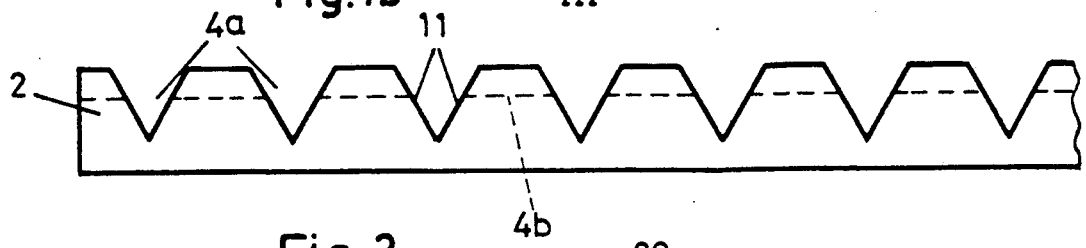

FIG. 1*b* shows another plate, one in which the grooves 4*a* and 4*b* are V-shaped in cross-section. The side surfaces intersect at an angle substantially smaller than 90°. In addition to the grooves shown here, other groove shapes are conceivable, for example, grooves U-shaped in cross-section. The grooves may also be curved or arranged in a zigzag pattern.

Figure 4:
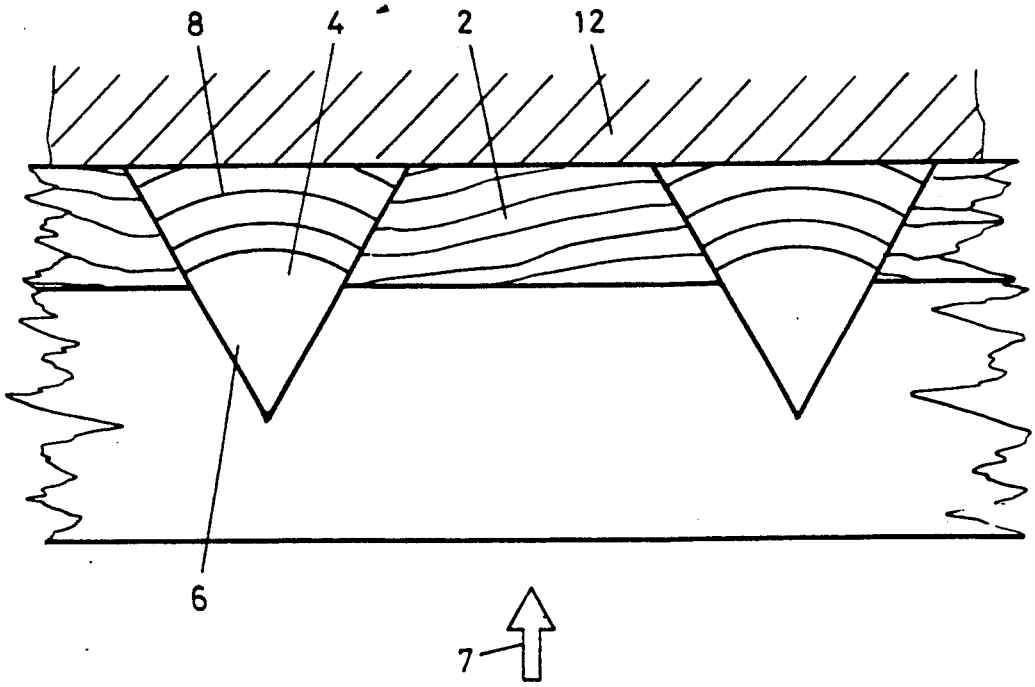
FIG. 4 presents a partial sectional view through the panel in FIG. 1*b*.

FIG. 4 shows a panel that is fastened, for example, on a ceiling 12 as ceiling liner. Sound striking the panel in the direction of the arrow 7 passes through the holes 6 into the grooves 4*a*. The sound, represented here diagrammatically by the lines 8, is absorbed by the material surrounding the grooves 4*a*. It goes without saying that additional panels as described in the present invention or other sound absorbing panels can be mounted between the panel 2 and the ceiling 12. The panel 1 or 2 is preferably backed with glass wool, rock wool, or the like. The sound emerging behind panel 1 or 2 is dissipated by the funnel-shaped groove, and as a result can penetrate the sound absorbing layer mounted behind the panel to particularly great effect.

It has been found that low-pitched sounds can be absorbed by resonance in the panel disclosed in the present invention.

Figure 5:
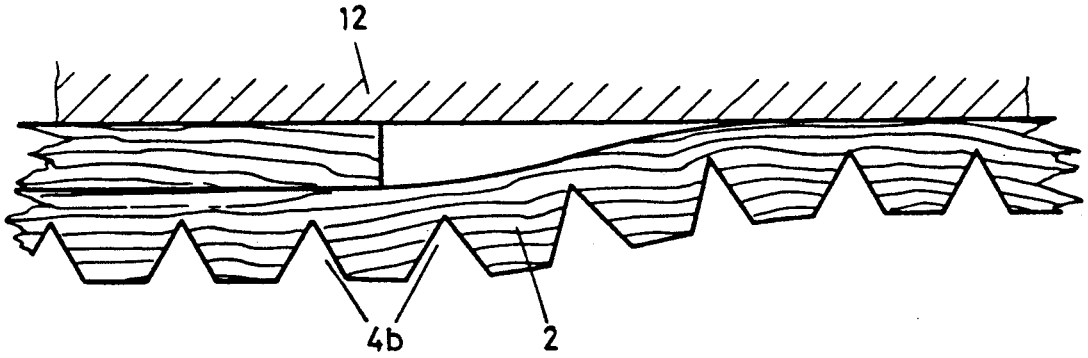
FIG. 5 is a diagrammatic representation of a partly bent panel.

As is shown in purely diagrammatical form in FIG. 5, the panel 2 may be partially or completely bent. The panels 1 and 2 described in the present invention are very flexible, like a panel of rubber, because of the intersecting grooves. One essential feature of the invention is that the panels 1 and 2 can be the same in design on both sides, thus making manufacture and use considerably easier. The grooves in the front surface may also be shallower than the ones in the rear surface, or may even be replaced by through holes.

In addition to the considerable advantages of the panel discussed above, it is to be seen that the panel is very simple and its production is marked by low material intensity enabling a sound absorbing panel to be constructed, which reflects light well, that both makes excellent allowance for acoustic requirements and, because of its flexibility, is versatile in use in architectural styling.

What is claimed is:

1. A sound absorbing panel for architectural styling, with several sound absorbing and piercing holes, wherein several grooves are incorporated in approximately parallel, opposite surfaces of the panel, the grooves of one surface intersecting with the grooves of the other surface, and said intersecting grooves having groove depths which form a sum greater than a thickness of the panel so as to form said holes at the intersections of the grooves, and wherein the grooves are V-shaped or funnel-shaped in cross-section.

2. The panel as set forth in claim 1, wherein the grooves intersect at an angle of approximately 90°.

3. The panel as set forth in claim 1 or 2, wherein the grooves exhibit a funnel-shaped cross-section.

4. The panel as set forth in claim 1, wherein the grooves are V-shaped in cross-section.

5. The panel as set forth in claim 1, wherein the grooves are V-shaped in cross-section in a bottom area of the groove, and the grooves have opposite surfaces which form an angle of approximately 90°.

6. The panel as set forth in claim 3, wherein the grooves have side surfaces that are parallel to each other.

7. The panel as set forth in claim 1, wherein said panel is a wooden panel.

8. The panel as set forth in claim 1, wherein the grooves on the opposite surfaces have different depths and in particular the groove depths on the opposite surfaces have a ratio of $\frac{1}{3}:\frac{2}{3}$, the grooves of the greater depth being provided on a rear side of said panel.

9. The panel as set forth in claim 1, wherein said panel is backed with glass wool or rock wool.

10. The panel as claimed in claim 1, wherein the panel has front surfaces which reflect light well so as to be suitable for use as a light reflector for a lighting fixture.

11. The panel as set forth in claim 1, wherein the holes are microfine holes having a diameter of approximately 1 mm.

12. The panel as set forth in claim 8 wherein the holes form openings extending over approximately 1.5% of the front face of the panel.

* * * * *

UNITED STATES PATENT AND TRADEMARK OFFICE

CERTIFICATE OF CORRECTION

PATENT NO. : 5,024,290

DATED : June 18, 1991

INVENTOR(S) : Otto Birker

It is certified that error appears in the above-identified patent and that said Letters Patent is hereby corrected as shown below:

Title page, item [75], delete "K nacht" and insert therefor --Küsnacht.--

Signed and Sealed this

Ninth Day of February, 1993

*Attest:*

STEPHEN G. KUNIN

*Attesting Officer*

*Acting Commissioner of Patents and Trademarks*